United States Patent [19]

Jones

[11] 3,981,728

[45]*Sept. 21, 1976

[54] XEROGRAPHIC IMAGING MEMBER HAVING HEXAGONAL SELENIUM IN INTER-LOCKING CONTINUOUS PATHS

[75] Inventor: Robert N. Jones, Fairport, N.Y.

[73] Assignee: Xerox Corporation, Stamford, Conn.

[ * ] Notice: The portion of the term of this patent subsequent to Jan. 22, 1991, has been disclaimed.

[22] Filed: July 24, 1975

[21] Appl. No.: 598,613

Related U.S. Application Data

[63] Continuation-in-part of Ser. No. 518,554, Oct. 29, 1974, Pat. No. 3,928,036.

[52] U.S. Cl. ..... 96/1.5; 252/501

[51] Int. Cl.[2] ..... G03G 5/087

[58] Field of Search ..... 96/1.5; 252/501

[56] References Cited

UNITED STATES PATENTS

| | | | |
|---|---|---|---|
| 2,663,636 | 12/1953 | Middleton | 96/1.5 |
| 3,787,208 | 1/1974 | Jones | 96/1.5 X |

*Primary Examiner*—David Klein
*Assistant Examiner*—John R. Miller

[57] ABSTRACT

A xerographic photoreceptor layer which comprises trigonal selenium particles dispersed in an insulating resin matrix, the trigonal selenium particles being present in an amount from about 1 to 25 percent by volume of the layer, and dispersed in a controlled manner to form a plurality of continuous paths through the thickness of said layer. Methods of making and imaging the photoreceptor layer are also disclosed.

20 Claims, 1 Drawing Figure

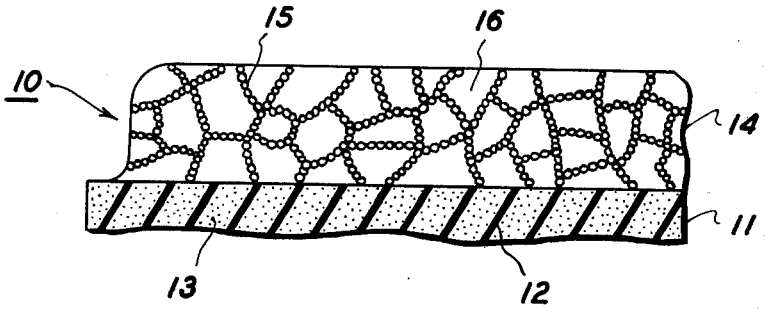
15
16
10
14
11
13
12

XEROGRAPHIC IMAGING MEMBER HAVING HEXAGONAL SELENIUM IN INTER-LOCKING CONTINUOUS PATHS

This application is a continuation-in-part of Applicant's copending application Ser. No. 518,554, filed Oct. 29, 1974, now U.S. Pat. No. 3,928,036.

BACKGROUND OF THE INVENTION

This invention relates to xerography and, more specifically, to a novel photoreceptor member.

The art of xerography involves the use of a photosensitive element or member containing a photoconductive insulating layer which is first uniformly electrostatically charged in order to sensitize its surface. The plate is then exposed to an image of activating electromagnetic radiation, such as light, X-ray or the like, which selectively dissipates the charge in the exposed areas of the photoconductive insulator by leaving behind a latent electrostatic image in the non-exposed areas. This latent electrostatic image may then be developed and then made visible by depositing finely divided electroscopic marking particles on the surface of the photoconductive layer. This concept was originally developed by Carlson in U.S. Pat. No. 2,297,691, and is further amplified and described by many related patents in the field.

One type of photoconductive layer used in xerography is illustrated by U.S. Pat. No. 3,121,006 to Middleton et al, which describes a number of binder layers comprising finely divided particles of a photoconductive inorganic compound dispersed in an electrically insulating organic binder. In one commerical form, the binder layer contains particles of photoconductive zinc oxide dispersed in an insulating resin binder which is coated on a paper backing. In the Middleton et al patent, a relatively high volume concentration of photoconductor, up to about 50 percent or more by volume, is usually necessary in order to obtain sufficient photoconductor particle-to-particle contact for rapid discharge. Such high loadings of photoconductor in a binder layer, result in the physical continuity of the resin being destroyed, thereby significantly reducing the mechanical properties of the binder layer. In addition, the utilization of high photoconductor volume loadings, and correspondingly low binder concentrations, results in poor mechanical properties in terms of cohesion, adhesion, flexibility, toughness and/or results in a porous film which can result in undesirable humidity, sensitive and fatigue effects. At the same time surface porosity tends to negate residual toner removal and, therefore, the capability of repeated cycling of the photoreceptor in the xerographic imaging mode.

In U.S. Pat. No. 3,787,208, to R. N. Jones, the above high photoconductor concentration disadvantages were overcome by the discovery of a method of making a novel photoconductive binder layer which enables the use of relatively low photoconductor volume concentrations. In addition to excellent mechanical properties of such a binder layer, this binder layer also exhibits excellent electrical characteristics which enable the photoreceptor to be used in a cycling manner. The photoreceptor of the present invention further improves the electrical properties of the photoreceptor disclosed in Jones, U.S. Pat. No. 3,787,208 and in particular, improves long-term cyclic stability, increases spectral response and possesses positive charge capabilities over those exhibited by the photoreceptors disclosed in U.S. Pat. No. 3,787,208.

OBJECTS OF THE INVENTION

It is, therefore, an object of this invention to provide a photoreceptor containing trigonal selenium and having an extremely high binder to photoconductor volume ratio.

It is another object of this invention to provide a photoreceptor with improved long-term cyclic stability.

It is a further object of this invention to provide a photoreceptor with increased spectral response.

It is a further object of this invention to provide a photoreceptor with a positive charge capability.

SUMMARY OF THE INVENTION

The foregoing objects and others are accomplished in accordance with this invention by providing a photoreceptor device which comprises a photoconductive layer comprising a polymeric matrix of an electrically insulating elastomeric resin containing an interlocking network of trigonal selenium particles in the form of continuous chains which pass through the photoconductive layer thickness. The trigonal selenium is present in a volume concentration of from about 1 to 25 percent by volume of the binder layer, preferably from about 3 to 15 percent by volume.

In accordance with the instant invention, the required control of the bulk geometry is attained by employing a binder or a matrix material in particulate form and physically mixing the particulate binder material with particulate trigonal selenium having a certain critically controlled size range. The matrix material and particulate trigonal selenium are then formed into a permanent binder layer by fusing or melting the binder particles together in any convenient manner to form a binder layer in which the dispersion of trigonal selenium particles is characterized by continuous paths of contacting trigonal selenium particles contained in the resin binder matrix. By controlling the geometry of the binder layer in accordance with the instant invention, greatly improved mechanical flexibility can be attained for xerographic binder layers. This is due to extremely low photoconductor concentrations, i.e., trigonal selenium, which result in the film or binder layer exhibiting substantially the mechanical properties of the resin or binder matrix inasmuch as the binder constitutes a major portion of the layer. In addition, free standing films or self-supporting binder layers may be easily fabricated inasmuch as binder materials can be selected which have the desired flexibility and strength to be used without the necessity of a supporting substrate or backing. The instant invention also allows for a wider choice of both the binder material, which may be used in order to achieve any desired physical property. In addition to the advantages in mechanical properties, the instant invention obviates the disadvantages of cyclic fatigue characteristics which are an inherent problem in the general binder systems described above. The instant invention therefore eliminates the necessity to compromise between the mechanical and electrical properties of a xerographic binder layer, making these essentially independently controlled parameters.

The present invention is especially suitable for producing a photoconductive binder structure for employment in a multiple use high-speed xerographic machine. By employing an extremely low volume concentration of trigonal selenium particles and by carefully controlling the particle size of the trigonal selenium and particulate binder material, the orientation of the trigonal selenium particles in binder layer may be preselected so as to form continuous trigonal selenium paths through the thickness of the binder layer. More specifically, binder materials of this invention are used in a particulate form having a restricted mean diameter and size distribution in relationship to the trigonal selenium particles. A mixture of these particles in the proper proportion can then be dispersed in a suitable fluid carrier medium in which neither the binder nor trigonal selenium is soluble. A continuous film may then be formed by coating a substrate with this dispersion, removing the fluid carrier, and coalescing the binder particles together by the application of heat and/or pressure, the vapors of a suitable solvent, or by any other suitable method. The final binder layer is characterized by the major portion of the trigonal selenium particles being arranged in the form of continuous paths throughout a substantially continuous matrix of the binder material.

An important step in the instant invention involves the trigonal selenium geometry control which is achieved by employing a particulate binder material having a correct size distribution. The instant concept may be illustrated by the following example: A photoconductive binder layer is made by forming a particulate mixture of trigonal selenium having a size distribution of about 0.001 to 2.0 microns with a thermoplastic resin binder having a particle size distribution of about 1 to 70 microns. The trigonal selenium is present in a concentration from about 1 to 25 percent by volume, preferably from about 3 to 15 percent by volume. The mixture is dispersed in a suitable fluid carrier in which neither the photoconductor nor binder is soluble. The dispersion is coated onto a metal substrate and the carrier fluid allowed to evaporate. The dried layer is then heated to fuse the binder particles into a binder matrix containing trigonal selenium particles in the form of continuous paths in particle-to-particle contact throughout the thickness of the binder layer. The size of the resin particles should, in general, be at least about 5 times that of the trigonal selenium particles. It should be noted that if the particle size of the trigonal selenium approaches that of the binder, the desired geometry of the trigonal selenium particles cannot be achieved and the trigonal selenium particles become completely encased in the binder matrix. In this case, the desirable results of the instant invention are not achieved, as will be shown later.

Binder layers of the controlled dispersion type described above exhibit a combination of electrical characteristics and mechanical properties which are superior to those of the binder systems of the uniform dispersion type as exemplified by the examples described in the Middleton et al patent. Furthermore, the photoreceptor of the instant invention further improves the electrical properties of the photoreceptors disclosed in Jones U.S. Pat. No. 3,787,208, and in particular, improves long-term cyclic stability, increases spectral response and possesses positive charge capabilities.

As mentioned above, another embodiment of the instant invention comprises providing a xerographic imaging member which includes a photoconductive insulating layer, said layer comprising an insulating organic matrix and trigonal selenium, with substantially all of the trigonal selenium in said member in a multiplicity of interlocking trigonal selenium continuous paths through the thickness of said layer, said trigonal selenium paths being present in a volume concentration, based on the volume of said layer, of from about 1 to 25 percent, preferably from about 3 to 15 percent, with the outer surface of said layer comprising organic resin material. A latent electrostatic image may be formed on at least one surface of said layer and developed to form a visible image. The latent electrostatic image may be formed by uniformly electrostatically charging the surface of said layer and exposing said layer to a source of activating radiation.

Furthermore, another embodiment of the instant invention comprises providing a xerographic imaging member which includes a photoconductive insulating layer, said layer comprising an insulating organic resin matrix containing therein trigonal selenium particles, with substantially all of the trigonal selenium particles being in substantially particle-to-particle contact in said member in a multiplicity of interlocking trigonal selenium paths through the thickness of said layer, said trigonal selenium paths being present in a volume concentration, based on the volume of said layer, of from about 1 to 25 percent, with the outer surface of said layer comprising organic resin material.

DETAILED DESCRIPTION OF THE DRAWINGS

FIG. 1 represents imaging device 10 of the present invention containing a conductive substrate 11 having thereon a photoconductive binder layer 14.

Substrate 11 may be preferably of a conductive material such as brass, aluminum, steel or a conductively coated dielectric or insulator. The substrate may be of any conventional thickness, rigid or flexible, or in any desired form such as a sheet, web, belt, plate, cylinder, or the like. It may also comprise other materials such as a metallized paper, plastic sheets coated with a thin layer of metal such as aluminum or copper iodide, or glass coated with a thin layer of chromium or tin oxide. In some instances, if desired, the support may be an electrical insulator or dielectric and charging carried out by techniques well known to the art, such as by simultaneously corona charging both sides of the plate with charges of the opposite polarity. Alternatively, after formation of the binder layer, the support member may even be dispensed with entirely.

Layer 14 comprises an interlocking network of trigonal selenium particles 15 contained in a substantially electrically insulating organic matrix material 16. Matrix material 16 may comprise any electrically insulating resin which can be obtained or made in particulate form, cast into a film from a dispersion, and later processed to form a smooth continuous binder layer. Typical resins include polysulfones, acrylates, polyethylene, styrene, diallyphthalate, polyphenylene sulfide, melamine formaldehyde, epoxies, polyesters, polyvinyl chloride, nylon, polyvinyl fluoride and mixtures thereof. Thermoplastic and thermosetting resins are preferred in that they may be easily formed or coalesced into the final binder layer by simply heating the particulate layer. The photoconductor phase, i.e., the trigonal selenium particles, is maintained in the form of a series or network of contacting chains which pass through the binder layer thickness. The trigonal selenium particles are maintained in a concentration of about 1 to 25 percent by volume or less and fabricated according to the concepts disclosed in Jones, U.S. Pat. No. 3,787,208 which is incorporated herein by reference.

The particulate mixture of resin and trigonal selenium particles are normally dispersed in a fluid carriers such as a liquid in which neither the resin nor the trigonal selenium particles are soluble. Alternatively, the carrier fluid may comprise a gas such as air.

In general, the thickness of the binder layer should be between about 10 to 80 microns, but thicknesses outside this range may also be used.

The photoconductor for use in the instant invention is trigonal selenium. In the crystalline trigonal form, the structure of the selenium consists of helical chains of selenium atoms which are parallel to each other along the crystallographic c-axis. Trigonal selenium is not normally used in xerography as a homogeneous photoconductive layer because of its relatively high electrical conductivity in the dark.

U.S. Pat. Nos. 2,739,079 and 3,692,521 both describe photosensitive members utilizing small amounts of crystalline hexagonal (trigonal) selenium contained in predominantly vitreous selenium matrices. In addition, copending U.S. patent application Ser. No. 669,915, filed Sept. 22, 1967, describes a special form of red-hexagonal selenium suitable for use in binder structures in which finely divided red-hexagonal selenium particles are contained in a resin binder matrix.

Although trigonal selenium exhibits a wider spectral response than vitreous selenium, as stated above, trigonal selenium is not normally used in xerography because of its relatively high electrical conductivity in the dark. However, imaging systems which are able to use a homogeneous layer of hexagonal (trigonal) selenium would have advantages over those using vitreous selenium with regard to improved spectral response and increased sensitivity. Further, the use of trigonal selenium layers in a specifically constructed xerographic member could provide better overall characteristics than vitreous selenium photoconductors. The trigonal selenium suitable for use in the instant invention includes the crystalline selenium as described in U.S. Pat. No. 1,915,703. Also, the crystalline trigonal selenium of the instant invention may be produced by the method described in copending U.S. patent application Ser. No. 473,859, filed May 28, 1974, now U.S. Pat. No. 3,954,464. Also, the trigonal selenium described in U.S. Pat. Nos. 2,739,079 and 3,692,521 may be used in the instant invention.

DESCRIPTION OF THE PREFERRED EMBODIMENTS

The following examples further specifically define the present invention with respect to a method of making and testing a flexible photoreceptor member. The examples below are intended to illustrate various preferred embodiments of the present invention.

EXAMPLE I 10 parts by volume of particulate trigonal selenium (also known as hexagonal selenium) having a particle size of about 300 Angstrom Units (0.003 microns) and a particle size distribution of from about 0.001 to 0.4 micron, is dispersed in a cyclohexanol liquid carrier with 90 parts by volume of a polyester resin (available from Goodyear under the tradename Flexclad) which has been ground and classified to have an average particle size of 5 microns and a distribution of from about 1 to 10 microns. The film of the dispersion is coated on an aluminum substrate, the liquid carrier then evaporated by heating to 60°C., and the coating fused to form a continuous layer 20 microns thick by heating for 4 minutes at 165°C.

The resulting binder layer is suitable for use in any conventional electrophotographic process involving charging, exposure and the development of a latent electrostatic image and exhibits improved excellent long-term cyclic stability, increased spectral response and a positive charge capability.

EXAMPLE II 14 parts by volume of particulate trigonal selenium (also known as hexagonal selenium) having a particle size distribution of 0.5 to 2 microns is dispersed in a carrier liquid (cyclohexanol) with 86 parts by volume of a polyester resin (available from Goodyear under the tradename Flexclad) which has been ground and classified to have an average particle size of 4 microns with a particle size distribution of from about 1 to 10 microns. A film of this dispersion is coated onto an aluminum substrate, the carrier liquid is evaporated by heating to 60°C., and the coating fused to form a continuous layer 20 microns thick by heating for 1 minute at 230°C.

The resulting binder layer is suitable for use in any conventional xerographic process involving charging, exposure and the development of a latent electrostatic image and exhibits improved excellent long-term cyclic stability, increased spectral response and a positive charge capability.

Although specific components and proportions have been stated in the above description of the specific embodiments of this invention, other suitable materials and procedures, such as those listed above, may be used with similar results. In addition, other materials may be utilized which synergize, enhance or otherwise modify the portions of the device of the instant invention.

Other modifications and ramifications of the present invention would appear to those skilled in the art upon reading the disclosure. Those are intended to be included within the scope of this invention.

What is claimed is:

1. A xerographic imaging member which includes a photoconductive insulating layer, said layer comprising an insulating organic matrix and hexagonal selenium, with substantially all of the hexagonal selenium in said member in a multiplicity of interlocking hexagonal selenium continuous paths through the thickness of said layer, said hexagonal selenium paths being present in a volume concentration, based on the volume of said layer, of from about 1 to 25 percent, with the outer surface of said layer comprising organic resin material.

2. The layer of claim 1 in which the hexagonal selenium is present in an amount from about 3 to 15 percent by volume.

3. The layer of claim 1 in which the matrix material is selected from the group consisting of thermoplastic and thermosetting resins.

4. The layer of claim 1 in which the resin comprises a material selected from the group consisting of polysulfones, acrylates, polyethylene, styrene, diallyphthalate, polyphenylene sulfide, melamine formaldehyde, epoxies, polyesters, polyvinyl chloride, nylon, polyvinyl fluoride and mixtures thereof.

5. The layer of claim 1 in which the resin material comprises a polyester.

6. The member of claim 1 which includes a supporting substrate.

7. A method of imaging which comprises:

a. providing a xerographic imaging member which includes a photoconductive insulating layer, said layer comprising an insulating organic resin matrix and hexagonal selenium, with substantially all of the hexagonal selenium in said member in a multiplicity of interlocking hexagonal selenium continuous paths through the thickness of said layer, said hexagonal selenium paths being present in a volume concentration, based on the volume of said layer, of from about 1 to 25 percent, with the outer surface of said layer comprising organic resin material;

b. forming a latent electrostatic image on at least one surface of said layer; and c. developing said latent electrostatic image to form a visible image.

8. The method of claim 7 in which the hexagonal selenium particles are present in an amount from about 3 to 15 percent by volume.

9. The method of claim 7 in which the latent electrostatic image is formed by uniformly electrostatically charging the surface of said layer and exposing said layer to a source of activating radiation.

10. The method of claim 7 in which the imaging steps (b) and (c) are repeated at least one additional time.

11. A xerographic imaging member which includes a photoconductive insulating layer, said layer comprising an insulating organic matrix containing therein hexagonal selenium particles, with substantially all of the hexagonal selenium being in substantially particle-to-particle contact in said member in a multiplicity of interlocking hexagonal selenium paths through the thickness of said layer, said hexagonal selenium paths being present in a volume concentration, based on the volume of said layer, of from about 1 to 25 percent, with the outer surface of said layer comprising organic resin material.

12. The layer of claim 11 in which the hexagonal selenium is present in an amount from about 3 to 15 percent by volume.

13. The layer of claim 11 in which the matrix material is selected from the group consisting of thermoplastic and thermosetting resins.

14. The layer of claim 11 in which the resin comprises a material selected from the group consisting of polysulfones, acrylates, polyethylene, styrene, diallyphthalate, polyphenylene sulfide, melamine formaldehyde, epoxies, polyesters, polyvinyl chloride, nylon, polyvinyl fluoride and mixtures thereof.

15. The layer of claim 11 in which the resin material comprises a polyester.

16. The member of claim 11 which includes a supporting substrate.

17. A method of imaging which comprises:

a. providing a xerographic imaging member which includes a photoconductive insulating layer, said layer comprising an insulating organic resin matrix containing therein hexagonal selenium particles, with substantially all of the hexagonal selenium being in substantially particle-to-particle contact in said member in a multiplicity of interlocking hexagonal selenium paths through the thickness of said layer, said hexagonal selenium paths being present in a volume concentration, based on the volume of said layer, of from about 1 to 25 percent, with the outer surface of said layer comprising organic resin material;

b. forming a latent electrostatic image on at least one surface of said layer; and c. developing said latent electrostatic image to form a visible image.

18. The method of claim 17 in which the hexagonal selenium particles are present in an amount from about 3 to 15 percent by volume.

19. The method of claim 17 in which the latent electrostatic image is formed by uniformly electrostatically charging the surface of said layer and exposing said layer to a source of activating radiation.

20. The method of claim 17 in which the imaging steps (b) and (c) are repeated at least one additional time.

* * * * *